US007140559B2

(12) United States Patent
Giulano

(10) Patent No.: US 7,140,559 B2
(45) Date of Patent: Nov. 28, 2006

(54) SPRAYING DEVICE FOR SERIAL SPRAYING OF WORK PIECES

(75) Inventor: Stefano Giulano, Gerlingen (DE)

(73) Assignee: Behr Systems, Inc., Auburn Hills, MI (US)

( * ) Notice: Subject to any disclaimer, the term of this patent is extended or adjusted under 35 U.S.C. 154(b) by 188 days.

(21) Appl. No.: 10/899,997

(22) Filed: Jul. 27, 2004

(65) Prior Publication Data

US 2005/0029368 A1 Feb. 10, 2005

(30) Foreign Application Priority Data

Jul. 28, 2003 (DE) ..... 103 34 412

(51) Int. Cl.
*A62C 31/00* (2006.01)

(52) U.S. Cl. ..... 239/436; 239/437; 239/438; 239/443; 239/444; 239/448

(58) Field of Classification Search ..... 239/436, 239/437, 438, 443, 444, 448, 581.1, 581.2; 118/323, 683, 300, 674, 410
See application file for complete search history.

(56) References Cited

U.S. PATENT DOCUMENTS

| | | | | |
|---|---|---|---|---|
| 3,201,048 A | | 8/1965 | Gibbs | 239/422 |
| 4,846,226 A | | 7/1989 | Merritt | 137/871 |
| 4,993,353 A | * | 2/1991 | Ogasawara et al. | 118/302 |
| 5,044,889 A | * | 9/1991 | Pinkerton | 417/53 |
| 5,676,756 A | * | 10/1997 | Murate et al. | 118/629 |
| 6,050,498 A | | 4/2000 | Minoura et al. | 239/112 |
| 6,328,799 B1 | * | 12/2001 | Inoue et al. | 118/323 |
| 6,589,342 B1 | * | 7/2003 | Attinoto et al. | 118/308 |
| 6,705,545 B1 | * | 3/2004 | Sroka et al. | 239/112 |

FOREIGN PATENT DOCUMENTS

| | | | |
|---|---|---|---|
| DE | 43 39 301 A1 | 11/1993 | |
| EP | 1 000 667 A2 | 5/2000 | |
| JP | 07227556 | 2/1994 | |
| US | 2003/002567 A1 | 1/2003 | 239/526 |

* cited by examiner

*Primary Examiner*—Davis Hwu
(74) *Attorney, Agent, or Firm*—Young & Basile, P.C.

(57) ABSTRACT

A spraying device such as an atomizer mounted to a painting robot of an installation for the serial spraying of work pieces contains both the color change valve arrangement and a metering pump located between the color changer and the spray head. The metering pump is preferably a valveless rotary piston pump, and for the color changer a suitably miniaturized arrangement and construction for the valve assemblies is preferred.

20 Claims, 3 Drawing Sheets

SPRAYING DEVICE FOR SERIAL SPRAYING OF WORK PIECES

BACKGROUND OF THE INVENTION

1. Field of the Invention

The invention relates in general to a spraying device which is mounted, or can be mounted, to the wrist axis of a robot or other multi-axis manipulator.

2. Description of the Related Art

In typical coating plants today, the possibly exchangeable atomizers mounted to robots or other program-controlled movable machines are connected to the necessary color changing and metering systems in the installation by external hoses. The color changers usually consist of modular valve assemblies, whose number corresponds to the selectable colors and which are combined in a block with a generally straight central passage common to all colors. The color chargers can, for example, be connected to a circulation line for the particular color (EP 0 979 964). Color changers of this type are also known which, to reduce space, contain a spiral groove in place of the usual straight central passage, at right angles to the longitudinal axis of the color changer manifold (DE 43 39 301), but this is less conducive to flow. In principle, color changers of this type enable a quick change between the available colors during paint operations. Although it is known that they should be located as close as possible to the paint application, in practice the color change valve arrangements have always been located outside the atomizer. For paint metering, volumetrically operating gear metering pumps or piston metering devices (metering cylinders) are used, which in newer systems are placed upstream or downstream of paint lines cleaned with a slug (DE 100 33 987, DE 101 57 966, DE 101 57 938, etc.). In their place, metering using closed-loop paint volume control is known, which basically consists of an electronic universal controller as the regulating device, a paint pressure regulator serving as an actuator and a flow rate meter for recording actual values, which are placed upstream of the main needle valve acting as the shut-off device in the customary atomizer (Dürr/Behr Technical Manual February 1994 "Paint Volume Control"; DE 101 42 355).

It is already known to install metering pumps configured as a gear pump or piston metering devices in the atomizer (DE 101 15 463; DE 101 36 720; EP 0693 319).

Because of the principle disadvantages of relatively long hose connections between the external color change valve arrangements and the atomizer, such as loss of paint or time, or cleaning problems when changing colors, the attempt has already been made to install color change systems in the atomizer, for example with several hollow needle valves permanently assigned to one color (WO 97/24189) or with several containers that can be pivoted around a common axis, which in one position are docked to the spray head and in another position to connections for an external color change valve arrangement (EP 0 792 695). These systems are relatively unwieldy and hardly practicable for small atomizers such as are needed for coating interiors, for example, or other confined work piece areas. Atomizers are further known with changeably mounted paint cartridges, which, for example, are emptied by a proportionally adjustable fluid drive located outside the atomizer on or in the paint robot (EP 0 967 016). Such systems have the principle disadvantage that time is lost in replacing the cartridge when changing colors.

A coating station was also proposed in DE 101 12 601 whose color changer, consisting in the usual way of paint valves, can be located in the atomizer. The atomizer here is intended to contain a metering valve constituting the primary needle valve of the atomizer to act as a controlled actuator for the rate at which the coating material emerges. The metering valve substitutes for a metering pump or other volumetrically operating metering device.

Generally, considerable disadvantages can be identified in the customary coating equipment using atomizers of the category considered here, such as color change losses caused by the components, relatively long color change times, high push losses when changing colors, in the case of paint volume control, low reaction times compared to a metering pump, high cost of installation and maintenance and/or other problems resulting from the spatial separation in the arrangement of the color change and metering devices.

An object of the invention is to avoid the disadvantages of the known systems and to propose a spraying device of the category considered that allows the least possible loss during color changes and at the same time shorter color change times. Preferably this should be achieved while requiring small amounts of space.

SUMMARY OF THE INVENTION

As the result of the short hose connection between the color change valve arrangement and the spray head inside the atomizer forming the spraying device described here, the invention has the considerable advantage of extremely low losses in paint and time during a color change and at the same time enables a very convenient purging arrangement, wherein it is sometimes enough to flush out the small amount of residual paint remaining between the color changer and paint tube nozzle through the nozzle, as with the usual short purge procedure. For the same reasons, small paint losses and specific conditions result when pushing the paint to the paint tube. The number of system components needed is reduced to a minimum, dispensing with otherwise customary functional valves such as purge blocks. By using components that have long since proved themselves, the result is simple construction and maximum reliability. It is also advantageous that essentially the entire application technology can be moved to the atomizer, and application components no longer have to be located in the robot or the remainder of the application equipment.

Further particular advantages also result when refining the invention especially for installation in atomizers if suitable metering and/or color change devices with particularly low space requirements are selected.

The valveless piston pump described in DE 102 13 270 (EP 1 348 487), the entire contents of which are incorporated herein by reference, is preferably used here as the metering pump, whose piston is rotated at each piston stroke around its axis, which runs in the direction of the stroke and which distinguishes itself due to many fundamental advantages. Among these advantages are the very small dead volume of the pump, resulting in correspondingly lower paint and purging agent losses when changing colors, fast and effective purging of the pump head resulting in high productivity and process reliability when coating work pieces and great precision in metering (<0.2%) without pulsation and dynamic problems. In addition to these characteristics, the low weight and small size of the pump are of primary importance, so that it also fits into small atomizers, such as are desirable for painting robots when coating confined and hard-to-access work piece areas including interiors and with good dynamic properties. In addition, this pump manages with small and light drives because of its low torque requirement, while on the other hand it makes high transfer pressure possible, which can be needed for many high-viscosity coating materials for example. The pump has the additional advantage of simple and low-intensity maintenance design with few moving parts, in particular only one piston in the flow area easily manufactured with minimal tolerance. Even giving up these advantages, the invention can be implemented with other known volumetric metering pumps, for example, with a gear pump constructed as small as possible.

In the case of the inventive spray device it can be, for example, an electrostatically operating rotary atomizer with external and/or internal charging of the coating material or in special cases without charging, such as are customary for painting the exteriors of vehicle bodies. But, the invention is not restricted to this. The previously mentioned valveless piston metering pump could, for example, be located particularly advantageously, for one with respect to the requisite material pressure, in an airless atomizer with air assistance directly ahead of the atomizer nozzle. As known from the prior art, the airless atomizer effect is based on the pressure of the coating material to be atomized, for example the seam sealing material for vehicle bodies.

The miniaturized color changer described in the co-pending patent application Ser. No. 10/899,998 filed concurrently herewith in the name of Stefano Giulano and entitled Color Shuttle Valve Arrangement, which is incorporated herein in its entirety by reference, is preferably used as the color change valve arrangement. In that co-pending patent application, a plurality of pin or needle valves is distributed in star formation around a straight central passage or, stated differently, at least some of the valve assemblies with needle planes parallel to each other can be arranged next to each other. The central passage can be disposed parallel to and expediently on the same axis as the central longitudinal axis of the atomizer, in the case of a rotary atomizer, the axis of rotation. The valves preferably have a piston connected to the needle valve pressurized by a pressure medium to drive it and a device specifically formed by a spring which exerts a force on the needle valve directed oppositely to the pressure of the pressure medium. In addition to the space-saving star construction in the longitudinal direction of the central passage, at least one or more of the following features may be suitable for the further miniaturization of the color changer:

- the sealing surface of the needle valve situated opposite the surface of the valve seat preferably including the face of the needle tip and/or the surface of the valve seat consists of an elastomer material;
- the spring has a degressive characteristic;
- on the surface pressurized by the pressure medium the piston has a non-circular, for example, a flat, rectangular or oval cross-section;
- the pressure medium is brought from a pressure source at a pressure of more than 10 bar, preferably at least 20 bar;
- the drive device for applying the pressure medium to the piston contains at least two piston surfaces pressurized by the pressure medium disposed behind one another along the axis of piston motion;
- the drive device contains an energy converter to amplify the force of the pressure medium; and/or
- the drive device to which the pressure medium is brought is located outside the valve assembly and is connected thereto by a preferably flexible mechanical drive element.

Possibilities for implementing these features are described in the aforementioned, co-pending patent application.

If the choice among a great many colors is to be possible, so that a color changer for all these colors inside the atomizer would be too large and/or the corresponding number of hoses cannot be routed through the wrist of the manipulator, the possibility exists of limiting the color changer in the atomizer to a few, particularly frequently-required colors (high-runners) and to provide only at least one valve assembly connected to an additional external color change arrangement for the remaining colors.

At least for rarely-required colors (low-runners), two valve assemblies working alternately in an A/B operation can be provided. As part of the invention it is also possible to furnish only two valve assemblies within the atomizer as a color change valve arrangement, which can be disposed and operated, for example, in accordance with the A/B principle described in WO 97/00731. The paint supply lines of the color change valve arrangement can be suitably cleaned with a slug in a way known from the prior art. In particular when using the slug equipment it can also be expedient to locate two color changers driven in accordance with the A/B principle next to or behind one another.

To reduce the space required for the color changer and its normally pneumatic control lines, the further possibility exists of furnishing as valves for the color change valve arrangement in the way known from EP 1 205 256 pneumatic valves piloted by a solenoid valve or by other type of electric valve, which communicate or can communicate with an electronic control system through an array of electrical connections contained in the valve arrangement. In this, pneumatic valves are interposed in the central passage of the color changer and are opened and closed by pressurized air or another pressurized gas from a common pressurized gas line leading through the color changer to all valves. Inside the color changer a solenoid valve is interposed in the pressurized gas passage for the pneumatic valve. A data bus for digital control data can lead through the color changer linked to the solenoid valves by an electronic circuit. The previously required numerous control air hoses for the color changer are no longer needed.

Problems concerning the implementation of the connecting lines for the color changer through the wrist axis of the manipulator can moreover be solved by the rotary decoupler described in EP 1 285 733. As part of this solution, an internal component of the atomizer, to which the color changer and its arrangement of lines are attached, is carried rotatably to disconnect from the rotational motion of the wrist joint relative to its atomizer-side flange.

BRIEF DESCRIPTION OF THE DRAWINGS

The invention is explained in more detail with reference to the embodiments shown in the drawing wherein like reference numerals refer to like parts throughout the several views, and wherein.

DETAILED DESCRIPTION

Figure 1:
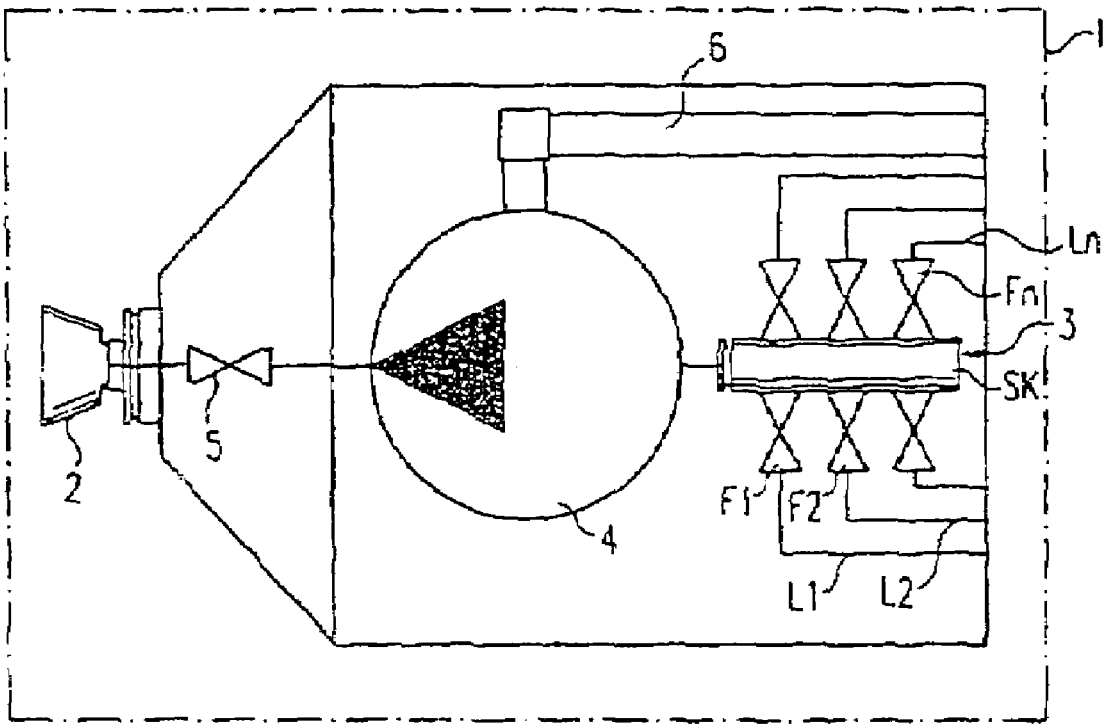
FIG. 1 shows the schematic representation of an atomizer with a color changer and a metering pump.

The rotary atomizer 1 shown schematically in FIG. 1 contains the rotary bell forming the spray head 2, for example driven in a known way by an air turbine, a color change valve arrangement identified by 3, in what follows simply called color changer, and a metering pump 4 located between the color changer 3 and the spray head 2. The metering pump 4 supplies the coating material to be sprayed to the spray head 2 through a controlled valve array 5, which contains the usual main needle valve for example. The color changer 3 essentially consists of a plurality of paint valve assemblies F1, F2 . . . Fn and, as required, one or more purge valve assemblies, which are connected on the input side to appropriate paint supply lines L1, L2 or Ln for a different color in each case and which open into a central, straight passage SK common to all valve assemblies. The central passage SK can be positioned co-axially with the axis of rotation of the atomizer 1 and is connected to the metering pump 4 at its outlet port. The arrangement of the preferably modular valve assemblies F1, F2, etc., composed of needle valves at the central passage SK can, for example, correspond to the design known from EP 0 979 964, in which the paint supply can have return lines in the manner of a circulation line for constant paint circulation, but does not need to have it. The central passage SK can be purged in a similarly known way. To drive the metering pump 4, a motor-driven flexible shaft 6 can be furnished outside the atomizer 1.

Figure 2:
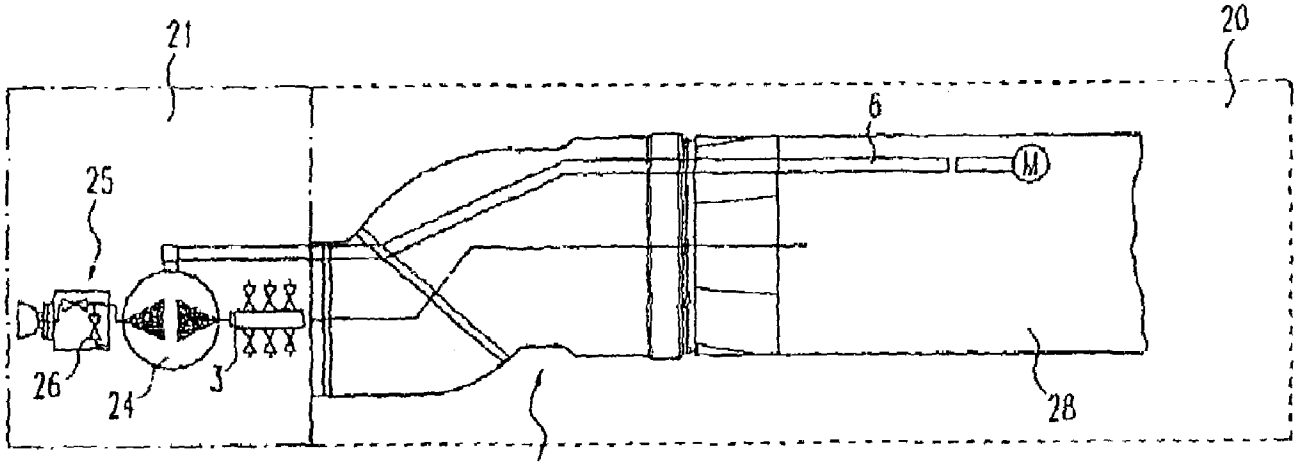
FIG. 2 shows a modified embodiment of the atomizer which here is mounted on the wrist of a paint robot.

FIG. 2 shows a rotary atomizer 21 in similar schematic fashion, which differs from that in FIG. 1 in that its built-in metering pump 24 is reversible, meaning that it can pump back toward the color changer 3. The valve arrangement 25 of the atomizer can contain a valve 26 for solvents, for example, for purging the central passage of the color changer 3.

In accordance with FIG. 2, the atomizer can be mounted to the wrist joint 27 of a paint robot 20, in whose arm 28 with the wrist the motor M can be located, which drives the metering pump 24, for example, through the flexible shaft 6.

Figure 3:
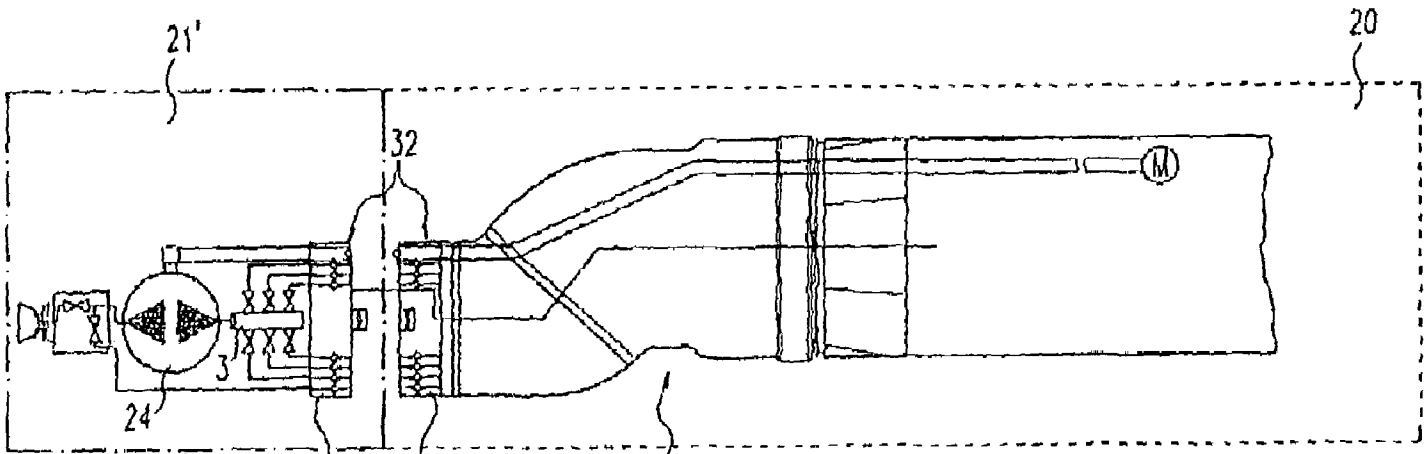
FIG. 3 shows an atomizer identical to that in FIG. 2, but installed removably.

In accordance with FIG. 3, an atomizer 21', which for the rest can be identical to the embodiment in accordance with FIG. 1 or FIG. 2, can be removable and replaceable at the wrist joint 27. In this case a coupling arrangement 32 of a known kind is located at the connecting flange 30 of the atomizer 21' and at the connecting flange 31 of the wrist joint 27, which can specifically contain quick-change couplings for the hose and other lines, including the electrical control lines required if electrically-piloted pneumatic valves are employed.

The atomizer 21' can be configured to be manually or preferably automatically detachable from the manipulator. Automatic atomizer changing systems are known from the prior art, for example from EP 1 245 296.

Figure 4:
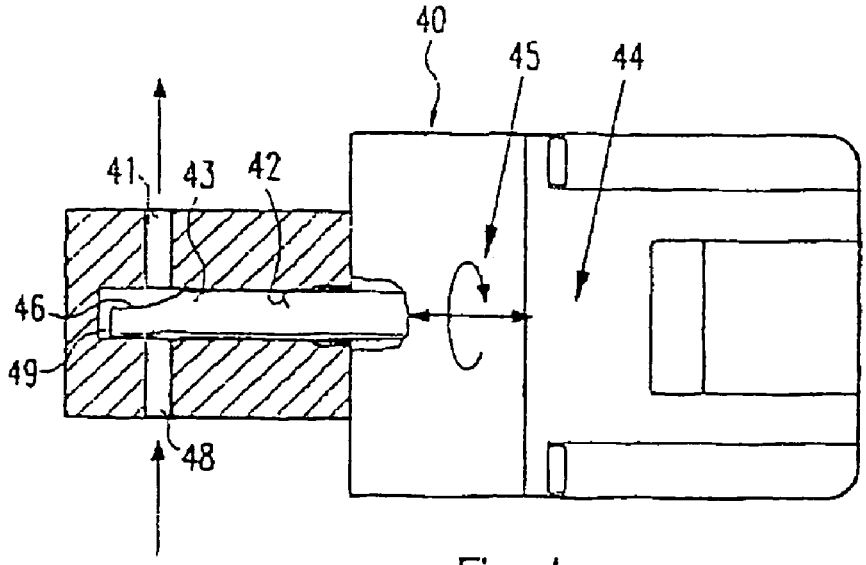
FIG. 4 shows a preferred metering pump.

The valveless piston pump 40 shown schematically in FIG. 4 is suitable for use as a metering pump 4 or 24 in the embodiments in accordance with FIGS. 1, 2 or 3 for the reasons explained at the beginning. As is described in greater detail in DE 102 13 270, it consists mainly of a cylindrical piston 43 displaceable lengthwise along its axis in a cylindrical bore 42 and a drive motor indicated by the arrow at 44 which displaces and at the same time rotates the piston in accordance with arrow 45. Coaxially oppositely disposed bores, which act as inlet port 48 or outlet port 41, lead transversely into the cylinder bore 42. In accordance with the known operating principle of this valveless piston pump, the piston 43 rotates one time around its own axis for each back-and-forth stroke. When the piston 43 is pulled back, the flat part 46 at the front part of the piston opens the inlet port 48. As a result, the paint color to be transferred and metered is sucked in and the pump chamber 49 is filled. As the piston 43 continues to rotate after the pump chamber 49 is completely filled, the inlet port 48 is closed by the piston 43, and with the opening of the outlet port 41 the discharge stroke begins.

If the color changer 3 is connected to a paint supply with pre-pressure that fluctuates too severely, and no adequate dynamic control is provided to compensate for small pressure spikes, a separate color pressure regulator can be furnished for each color for example. In place of such a regulator, a control loop of the type described in DE 101 42 355 can be furnished whose color changer interposed in the paint pressure line consists of a pneumatic or electrically driven needle valve. Or, in accordance with a refinement, in place of a separate paint pressure regulator downstream of the color changer the color control valves of the color changer are configured in each instance as an actuator, for example in the form of a needle valve.

Another refinement of the embodiments in accordance with FIGS. 1 to 3 consists of providing a proportional solenoid valve as a drive for the valve needle of the previously mentioned main needle valve for the atomizer for very short reaction times, as has been similarly described already in DE 101 42 355.

Figure 5:
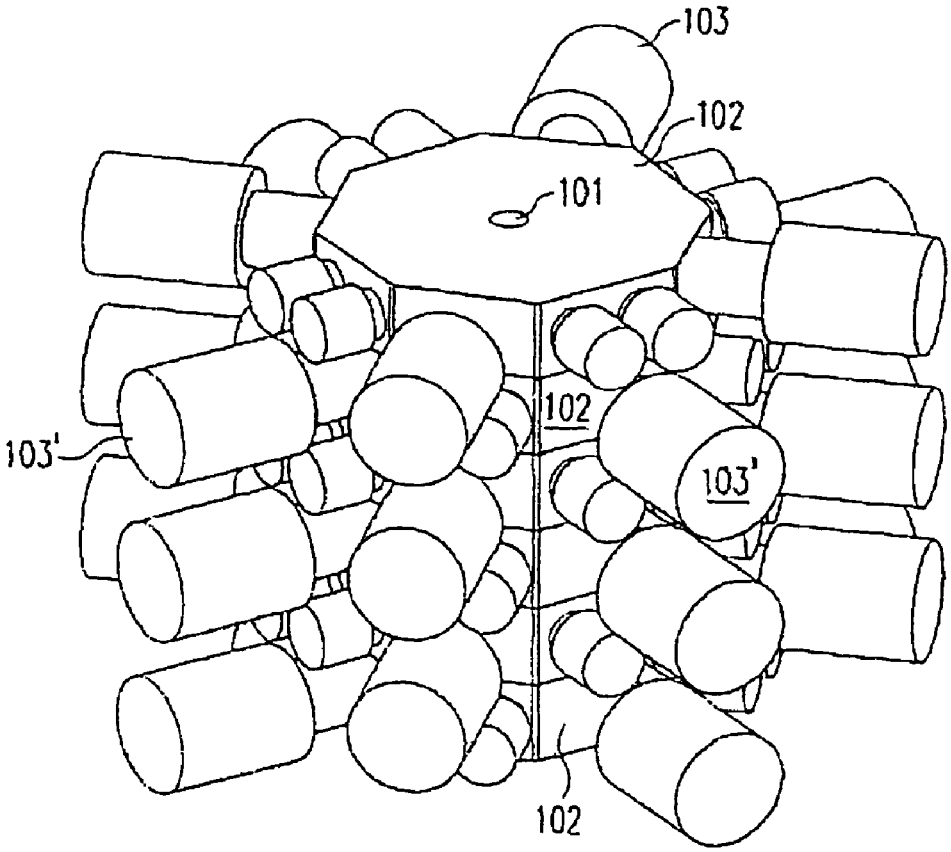
FIG. 5 shows a preferred design for a color changer.

The color changer shown in FIG. 5, which is also described in co-pending patent application Ser. No. 10/899,998 in the name of Stefano Giulano and entitled Color Shuttle Valve Arrangement, can be used expediently as the color changer 3 in the embodiments in accordance with FIGS. 1 to 3 for the reasons explained initially. It is accordingly a miniaturized color changer in the longitudinal direction of the central passage 101 (SK in FIG. 1) common to all valve assemblies, for 24 colors in this example, which is composed of a plurality of segments 102 stacked in modular fashion along the common passage 101, each of which contains four valve assemblies 103 or 103' in a star shape distributed at equal angular distances from each other around the common passage 101. The needle axes in the example shown lie in a common plane perpendicular to the common passage 101. If the valve assemblies are intended to open in a known way into the central passage 101 with their needle axes at an angle different from 90°, at least the center points of the valve seats of the four valves lie on a common plane perpendicular to the common passage 101.

To save even more space, the valve assemblies of adjacent segments 102 of the color changer, as shown in the drawing, are offset to each other in such a way that the valve assemblies 103 of one plane in each case lie in the center between the adjacent valve assemblies 103' of the other plane in the circumferential direction of the central passage 101.

The arrangement shown in FIG. 5 of four pin valves disposed in a star in each plane of the modular manifold block of the color changer represents in many cases an optimum particularly with respect to paint change losses, which depend, among other things, on the required diameter of the central passage. If an even flatter shape is preferred, an even greater number of valves can be distributed in one plane around the central passage, for example, six or eight valve assemblies. Undesirable color change losses can be prevented by other measures such as, for example, by reducing the cross section of the central passage by a central internal body (c.f DE 101 12 601). Also as described in the aforementioned co-pending patent application, the color changer can be connected by way of a quick-change coupling array to its connecting lines, including the supply and control lines.

The possibility explained on the basis of FIG. 5 of shortening the required length of the common central passage by the offset-angle arrangement of the valve assemblies 103 and 103' is not restricted to the example described, with several valve assemblies distributed in each plane around the central passage, but can be applied in general to reduce the space required perpendicular to the central passage going so far as the placement of only two valve assemblies or even only one valve assembly on each plane. For example, in the last named case, a single row of valve assemblies can be disposed along the central passage, in which adjacent valve assemblies along the central passage are offset to each other by a suitably selected angle, for example approximately 45°, so that two nested groups of valve assemblies are formed, each aligned with the other in the longitudinal direction of the central passage. The offset angle should be as small as possible on the one hand, in order to save space in the direction perpendicular to the central passage and perpendicular to the two valve groups, but on the other hand it must be selected so that the distance between the needle valves measured in the longitudinal direction of the central passage is smaller than the maximum diameter of the valve assemblies similarly measured in this longitudinal direction if there is to be any space saving in the longitudinal direction of the central passage. The mutual distance between the longitudinal needle axes of the adjacent valve assemblies should thus be smaller than the minimum distance which they would have to have with the same external dimensions for the valve assemblies, if the adjacent valve assemblies were to be aligned with each other without angular offset, as in known color changers.

What is claimed is:

1. A spraying device for coating material for the serial coating of work pieces that is mountable to a robot or another multi-axis manipulator, the spraying device comprising:

at least one spray head;

a color change valve arrangement for selectively connecting the spray head to lines bringing coating material of different colors; and a pump metering the coating material is located in the spraying device between the color change valve arrangement and the spray head; and wherein the color change valve arrangement comprises a plurality of valve assemblies, at least two of the plurality of valve assemblies having outlet ports lying in a plane running perpendicular to a longitudinal axis common to the color change valve arrangement and the metering pump and disposed about the longitudinal axis.

2. The spraying device according to claim 1 wherein the metering pump is a valveless piston pump including a piston rotated at each stroke around its axis running in the direction of the stroke.

3. The spraying device according to claim 1 wherein at least three valve assemblies in each case are disposed at equal angular distances around the longitudinal axis of the central passage.

4. The spraying device according to claim 1 wherein the color change valve arrangement has a pressure line common to all valve assemblies from which a pressure medium can be taken to the valve assemblies and wherein each of the valve assemblies has an electrically controlled valve interposed between its drive device and the common pressure line.

5. The spraying device according to claim 1 wherein the color change valve arrangement is furnished with a quick-change coupling array for the connecting lines for the valve assemblies.

6. The spraying device according to claim 1 wherein the metering pump is a reversible valveless piston pump.

7. The spraying device according to claim 1 each of the plurality of valve assemblies including:

an outlet port for coating material flowing in the direction of the applicator, the applicator forming a valve seat;

a needle valve carried movably in the valve assembly, the needle valve having a sealing surface abutting the valve seat when the needle valve is closed;

at least one piston connected to the needle valve, the piston operable to apply a force to drive the needle valve in response to a pressure medium;

means for exerting a force on the needle valve oppositely directed to pressure from the pressure medium; and a drive device for applying pressure from the pressure medium to the piston.

8. The spraying device according to claim 1 wherein at least two adjacent valve assemblies along the longitudinal axis are disposed offset at an angular distance of their needle axes of less than 90° around the central passage.

9. A spraying device for coating material for the serial coating of work pieces that is mountable to a robot or another multi-axis manipulator, the spraying device comprising:

at least one spray head;

a color change valve arrangement for selectively connecting the spray head to lines bringing coating material of different colors; end a pump metering the coating material located in the spraying device between the color change valve arrangement and the spray head, wherein the color change valve arrangement comprises a plurality of valve assemblies for the selectable colors, each of the plurality of valve assemblies including:

an outlet port for the coating material flowing in the direction of the applicator, the applicator forming a valve seat;

a needle valve carried movably in the valve assembly, the needle valve having a sealing surface abutting the valve seat when the needle valve is closed;

at least one piston connected to the needle valve, the piston operable to apply a force to drive the needle valve in response to a pressure medium;

means for exerting a force on the needle valve oppositely directed to pressure from the pressure medium; and a drive device for applying pressure from the pressure medium to the piston;

and wherein each of the plurality of valve assemblies open into a common central passage and wherein at least two of the plurality of valve assemblies having needle valve planes parallel to each other are disposed along the central passage next to each other.

10. The spraying device according to claim 9, wherein each of the plurality of valve assemblies further comprises means for at least one of amplifying a force exerted by the drive device on the piston and reducing an oppositely directed force to be overcome by the drive device.

11. The spraying device according to claim 10 wherein the means for at least one of amplifying and reducing comprises at least one of:

an elastomer material forming a sealing surface on at least one of the needle valve opposite a surface of the valve seat and the surface of the valve seat;

the exerting means including a spring having a degressive characteristic;

a non-circular cross-section on a surface of the piston pressurized by the pressure medium;

a pressure source supplying the pressure medium at a pressure of more than 10 bar;

the drive device including at least two piston surfaces disposed behind one another along an axis of motion of the piston, each pressurized by the pressure medium;

an energy converter included in the drive device to increase the force of the pressure medium; and a flexible mechanical drive element coupled to the drive device wherein the drive device is located outside the valve assembly.

12. The spraying device according to claim 9 wherein the metering pump is a reversible valveless piston pump.

13. The spraying device according to claim 9 wherein the color change valve arrangement has a pressure line common to all valve assemblies from which the pressure medium can be taken to the valve assemblies and wherein each of the valve assemblies has an electrically controlled valve interposed between its drive device and the pressure line.

14. The spraying device according to claim 9 wherein the color change valve arrangement is furnished with a quick-change coupling array for the lines bringing coating material of different colors.

15. A spraying device for coating material for the serial coating of work pieces that is mountable to a robot or another multi-axis manipulator, the spraying device comprising:

at least one spray head;

a color change valve arrangement for selectively connecting the spray head to lines bringing coating material of different colors; and a pump metering the coating material located in the spraying device between the color change valve arrangement and the spray head, wherein at least two adjacent valve assemblies in the longitudinal direction of a common central passage are disposed offset at an angular distance of their needle axes of less than 90° around the central passage and the distance of the needle axes measured in the longitudinal direction of the central passage is less than the maximum diameter of the valve assemblies similarly measured in this longitudinal direction.

16. The spraying device according to claim 15 wherein at least two valve assemblies whose outlet ports lie in a common first plane running perpendicular to the longitudinal axis of the central passage are disposed distributed round the longitudinal axis of the central passage and wherein at least two additional valve assemblies, whose outlet ports lie in a second plane parallel to the first plane, are disposed around the longitudinal axis of the central passage distributed such that the valve assemblies of the one plane in the circumferential direction of the central passage lie between the valve assemblies of the other plane.

17. The spraying device according to claim 15 wherein the metering pump is a reversible valveless piston pump.

18. The spraying device according to claim 15, at least one of the valve assemblies including:

an outlet port for coating material flowing in the direction of the applicator, the applicator forming a valve seat;

a needle valve carried movably in the valve assembly, the needle valve having a sealing surface abutting the valve seat when the needle valve is closed;

at least one piston connected to the needle valve, the piston operable to apply a force to drive the needle valve in response to a pressure medium;

means for exerting a force on the needle valve oppositely directed to pressure from the pressure medium; and a drive device for applying pressure from the pressure medium to the piston.

19. The spraying device according to claim 15 wherein the color change valve arrangement has a pressure line common to all valve assemblies from which a pressure medium can be taken to the valve assemblies and wherein each of the valve assemblies has an electrically controlled valve interposed between its drive device and the pressure line.

20. The spraying device according to claim 15 wherein the color change valve arrangement is furnished with a quick-change coupling array for the lines bringing coating material of different colors.

* * * * *